US011636746B2

(12) United States Patent
Nguyen et al.

(10) Patent No.: US 11,636,746 B2
(45) Date of Patent: Apr. 25, 2023

(54) DEVICE AND METHOD FOR SIMULATING SHADOWS AND/OR NOISES OF A PERSON

(71) Applicant: Mitipi AG, Fribourg (CH)

(72) Inventors: Khanh Nguyen, Allschwil (CH); Jakob Cevc, Zürich (CH); Laura Schilliger, Zürich (CH); Julian Stylianou, Winterthur (CH)

(73) Assignee: Mitipi AG, Fribourg (CH)

( * ) Notice: Subject to any disclaimer, the term of this patent is extended or adjusted under 35 U.S.C. 154(b) by 344 days.

(21) Appl. No.: 16/643,123

(22) PCT Filed: Aug. 27, 2018

(86) PCT No.: PCT/EP2018/073026
§ 371 (c)(1),
(2) Date: May 14, 2020

(87) PCT Pub. No.: WO2019/042940
PCT Pub. Date: Mar. 7, 2019

(65) Prior Publication Data

US 2020/0394885 A1 Dec. 17, 2020

(30) Foreign Application Priority Data

Aug. 31, 2017 (CH) ..... 01083/17
Jan. 5, 2018 (CH) ..... 00007/18

(51) Int. Cl.
*G08B 15/00* (2006.01)
*H05B 47/155* (2020.01)
(Continued)

(52) U.S. Cl.
CPC ..... *G08B 15/002* (2013.01); *F21S 10/00* (2013.01); *F21V 33/0056* (2013.01);
(Continued)

(58) Field of Classification Search
CPC .... G08B 15/002; H05B 45/12; H05B 47/155; F15S 10/00; F21V 33/0056; F21Y 2115/10
See application file for complete search history.

(56) References Cited

U.S. PATENT DOCUMENTS 4,970,489 A * 11/1990 Jenkins ..... G08B 15/002 340/555
5,442,524 A 8/1995 Farmer
(Continued)

FOREIGN PATENT DOCUMENTS

DE 10 2009 015466 A1 9/2010
DE 10 2011 084325 A1 4/2013
(Continued)

OTHER PUBLICATIONS

International Search Report, dated Nov. 26, 2018, for PCT/EP2018/073026, filed on Aug. 27, 2018, with English translation.
(Continued)

*Primary Examiner* — Ojiako K Nwugo
(74) *Attorney, Agent, or Firm* — Paul D. Bianco; Gary S. Winer; Fleit Intellectual Property Law

(57) ABSTRACT

A method and a device for simulating shadows of a person moving in a building, comprising basic lighting and intended to reproduce a particularly realistic simulation of a moving person in a simple manner. This is achieved by superimposing the at least two sequentially switched lamps on the basic lighting.

16 Claims, 4 Drawing Sheets

(51) Int. Cl.

| | |
|---|---|
| ***H05B 45/12*** | (2020.01) |
| ***F21S 10/00*** | (2006.01) |
| ***F21V 33/00*** | (2006.01) |
| *F21Y 115/10* | (2016.01) |

(52) U.S. Cl.
CPC ..... *H05B 45/12* (2020.01); *H05B 47/155* (2020.01); *F21Y 2115/10* (2016.08)

(56) References Cited

U.S. PATENT DOCUMENTS

| | | | | |
|---|---|---|---|---|
| 2008/0186149 | A1* | 8/2008 | Readler | G08B 15/002 340/309.16 |
| 2008/0186256 | A1* | 8/2008 | Readler | H05B 45/00 345/46 |
| 2016/0105764 | A1 | 4/2016 | Evans | |
| 2016/0227618 | A1* | 8/2016 | Meerbeek | H05B 47/16 |
| 2017/0211764 | A1* | 7/2017 | Price | F21S 8/006 |
| 2018/0320376 | A1* | 11/2018 | Di Trapani | F21V 7/005 |
| 2018/0352629 | A1* | 12/2018 | Crosbie | F21S 2/00 |
| 2019/0251814 | A1* | 8/2019 | Wolfinger | H05B 45/00 |

FOREIGN PATENT DOCUMENTS

| | | | |
|---|---|---|---|
| DE | 10 2014 214114 | A1 | 1/2016 |
| GB | 2392490 | A | 3/2004 |
| WO | 2018/073147 | A1 | 4/2018 |

OTHER PUBLICATIONS

English translation of Written Opinion for PCT/EP2018/073026, filed Aug. 27, 2018.
International Search Report, dated Nov. 26, 2018, for PCT/EP2018/073026, filed on Aug. 27, 2018.
Written Opinion for PCT/EP2018/073026, filed Aug. 27, 2018.

* cited by examiner

DEVICE AND METHOD FOR SIMULATING SHADOWS AND/OR NOISES OF A PERSON

FIELD OF THE INVENTION

The present invention describes a method and a device for simulating shadows and/or simulating noises of a person, particularly in the field of break-in protection and/or security technology or the like.

BACKGROUND

Various security devices for securing buildings or objects against illegal break-ins or illegal theft are known from the prior art. Here in particular, security devices exist, which prophylactically simulate the presence of people in a building, for example by switching on and off illumination of rooms at predetermined times or by automatic roller-shutter controls, in which roller shutters are automatically moved into an open position at daybreak and into a closed position at nightfall.

Furthermore, a device is known from U.S. Pat. No. 5,442,524 for simulating shadows of a person for improved security and for preventively deterring burglars in a private residence or a place of business. This device comprises a central light source and a cylindrical element rotating around the light source, which element generates the casting of a shadow onto a projection surface, e.g. the inner walls of the building and provokes the impression of a person moving in the building as a result.

In addition, diverse security devices are known from the prior art, which should simulate a switched-on TV set on the basis of flickering, differently coloured light sources, such as flickering LEDs for example.

A further device for simulating shadows of a person is known from the document DE 10 2011 084 325 A1 in the field of break-in protection or security technology. The device comprises a multiplicity of LED lights for imitating basic lighting, which function as a projector, and projects an image or for example the casting of a shadow onto a projection surface, particularly in a room. In this case, the image can be configured in such a manner that the presence of people or animals is simulated by the same. The projected image may in this case be provided on a screen. The device from DE 10 2011 084 325 A1 may likewise comprise a loudspeaker for simulating noises of a person.

These known security devices have the disadvantage that the simulations achieved do not imitate a person moving in a building in a particularly true manner.

SUMMARY OF THE INVENTION

One aspect of the present invention provides a method for simulating shadows of a person, particularly in the field of break-in protection and/or security technology or the like, and also a device for carrying out the method, wherein a particularly realistic simulation of a moving person should be reproduced in a simple manner.

According to an embodiment of the invention, the at least two lamps can be activated alternately in such a manner on the basis of the control and switched on or switched off in sequence, so that movements or shadows of a person are simulated. In other words, the at least two lamps connected in sequence may be understood as effect lights, which are superimposed onto a basic lighting.

In the sense of the present invention, at least one lamp, LED lamp in particular, which is switched on constantly, should simulate a switched-on lamp or create basic lighting.

Switching on or switching off in sequence is understood below to mean that the lamps are switched on alternately and in sequence, whilst an earlier lamp is switched off simultaneously or in a crossfading manner. In this case, the activated lamps to be switched on are activated in a sequence or diffusely, i.e. not sequentially.

It was advantageously found in this case that the impression of a person moving in a building can be simulated solely by means of a lamp sequence superimposed onto the basic lighting. The travelling light cones due to the lamps, which are preferably dimmed down or dimmed up in series, simulate such movements.

The at least two lamps, particularly LED lamps, which are switched in sequence, preferably allow a beam angle of 30° to 120°, more preferably 50° to 90°.

According to a preferred embodiment, in one setting of the device according to the invention, only the basic lighting may be switched on, as a result of which the device only functions as a lamp.

Further advantageous embodiments are also disclosed.

Preferably, the sequence circuit is configured in such a manner that in one setting, the at least two lamps can be switched on or switched off in sequence for creating a lamp sequence. As a result, short, i.e. not abrupt, transitions between the travelling light cones are created, and movements of a person which are as realistic as possible can advantageously be imitated.

More preferably, the control is configured in such a manner that in each case, a subsequent lamp, is dimmed up during the dimming down of the preceding lamp in the series. As a result, even softer transitions of the lamps switched in sequence can advantageously be achieved and thus imitate even more realistic movements of a person.

Preferably, the device according to the invention comprises at least one, preferably two, coloured, such as blue and/or red and/or green, LED lamps (preferably RGB LEDs) for simulating a switched-on TV set, wherein the blue LED lamps preferably allow a beam angle between 30° and 120°, more preferably between 50° and 90°. Particularly preferably, the control of the device according to the invention is configured in such a manner that in one setting, the white and blue LED lamps flicker diffusely, i.e. not in sequence, to simulate a switched-on TV set.

According to a preferred embodiment, the device according to the invention may comprise a means for creating the casting of a shadow, for example a silhouette placed between lamps and projection surface and at least partially non-light-permeable, which creates a shadow and can be attached on or integrated in the device for example. Alternatively or additionally, the device may comprise a light-shaping element which is placed between the lamps and the projection surface and is at least partially non-light-permeable. The use of such a light-shaping element has the advantage that the light cones which can theoretically be created can be delimited and, as a result, in particular the overlap of the light cones of adjacent lamps can be delimited in a targeted manner. It has advantageously been shown here that the effect of the shadow effects achieved by the lamp sequence can be influenced as desired, whilst in the case of simultaneous operation of all lamps, a uniform light image (i.e. without strong individual "hotspots") corresponding to a lamp which is switched on constantly without a simulated movement pattern, can be achieved.

Preferably, the device comprises a transparent or translucent light-permeable cover as protection for the lamps, i.e. this cover lets the created light cones of the lamps pass. Furthermore, it is conceivable that this transparent light-permeable cover has a corrugated structure for example, functions as a diffuser plate as a result and additionally disperses the light cones created by the lamps.

Furthermore, the device according to the invention can, according to a preferred embodiment, comprise a brightness sensor for detecting lamps located outside the device, for example ambient light, for automatically adapting the light intensity of the LED lamps. Alternatively or additionally to a brightness sensor, a computer of the device according to the invention can be equipped with a corresponding software, which adapts the light intensity of the lamps on the basis of day- and night-times.

Preferably, the device comprises at least one loudspeaker connected to the computer for simulating noises of a person. Very particularly preferably, the software stored on the computer is configured in such a manner that the noise simulation is adapted to a simultaneously generated shadow simulation.

Particularly preferably, the device comprises a microphone, wherein the microphone is used for detecting noises of third parties. For example, the microphone can be used for generating an acoustic counter-reaction to the noise of third parties.

BRIEF DESCRIPTION OF THE DRAWINGS

A preferred exemplary embodiment of the subject matter of the invention is described in the following in connection with the attached drawings. In the figures.

DETAILED DESCRIPTION

Figure 1A:
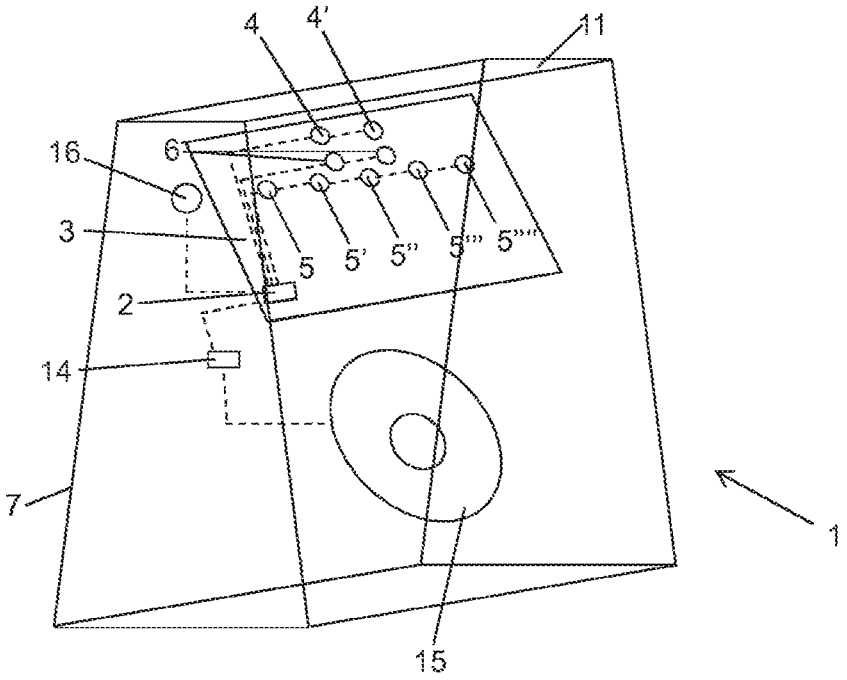
FIG. 1A shows a schematic front view of a first preferred embodiment of the device according to the invention.

FIG. 1A shows a schematic front view of a preferred embodiment of the device 1 according to the invention. The device comprises an LED circuit board 3, which is arranged inside a housing 7. Here, by way of example, two white LED lamps 4; 4' for creating basic lighting, five white LED lamps 5; 5'; 5"; 5'''; 5'''' arranged in a row and also two blue LED lamps 6; 6' for creating a TV simulation are arranged on the LED circuit board 3. The LED lamps 4; 4'; 5; 5'; 5"; 5'''; 5''''; 6; 6' used here are configured in a dimmable manner. The LED circuit board 3 is here arranged in an angled manner with respect to a transparent light-permeable cover 11, wherein the cover 11 is integrated directly into the housing 7. Here, the cover 11 allows the light cones of the LED lamps 4; 4'; 5; 5'; 5"; 5'''; 5'''; 6; 6' to pass (cf. FIGS. 2A and 2B). Alternatively, it is also conceivable that the LED lamps 5; 5'; 5"; 5'''; 5'''' arranged in a row can function both for creating the basic lighting and as effect lights (i.e. without additional LED lamps 4; 4' for creating the basic lighting). According to a further preferred embodiment (cf. FIGS. 3A and 3B), a light-shaping element may additionally be arranged between the circuit board 3 and the cover 11 for delimiting the light cones of the LED lamps 4; 4'; 5; 5'; 5"; 5'''; 5'''; 6; 6'.

As indicated dashed, the control 2 is connected to the LED lamps 4; 4'; 5; 5'; 5"; 5'''; 5''''; 6; 6' for the activation or actuation thereof. The control 2 is in turn connected to a computer 14 (for example Espressif or Raspberry Pi). The computer 14 contains software for actuating the control 2. On the basis of the software stored on the computer 14 and the control 2, the LED lamps 5; 5'; 5"; 5'''; 5'''' functioning as effect lights can be activated in such an alternating manner on the basis of the control 2 and switched on or switched off in sequence, so that the impression of a moving person is created.

Preferably, the device 1 according to the invention can be used in an operating setting as a pure LED lamp, i.e. without constant switching on or switching off of individual LED lamps.

Here, by way of example, the device 1 shown in FIG. 1A additionally comprises a brightness sensor 16 coupled to the control 2, for detecting lamps located outside the device, for example ambient light, for automatically adapting the light intensity of the LED lamps 4; 4'; 5; 5'; 5"; 5'''; 5''''; 6; 6'.

Furthermore, the device 1 shown in FIG. 1A shows a loudspeaker 15 connected to the computer 14 for simulating noises of a person.

Figure 1B:
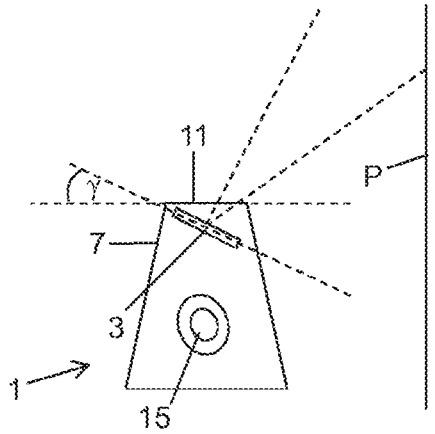
FIG. 1B shows a schematic side view of the first preferred embodiment of the device according to the invention.

FIG. 1B shows a schematic side view of the preferred embodiment for illustrating an angled LED circuit board 3. An angle $\gamma$ is spanned between the plane, in which the LED circuit board 3 lies, and the plane, in which the cover 11 integrated into the housing 7 lies (or the datum plane of the device). For example, an LED lamp (not visible in FIG. 1B) on the LED circuit board 3 creates a light cone projected onto a projection surface P (for example an interior wall of a building). Alternatively or additionally, it is also conceivable to angle individual LED lamps with respect to one another.

Figure 2A:
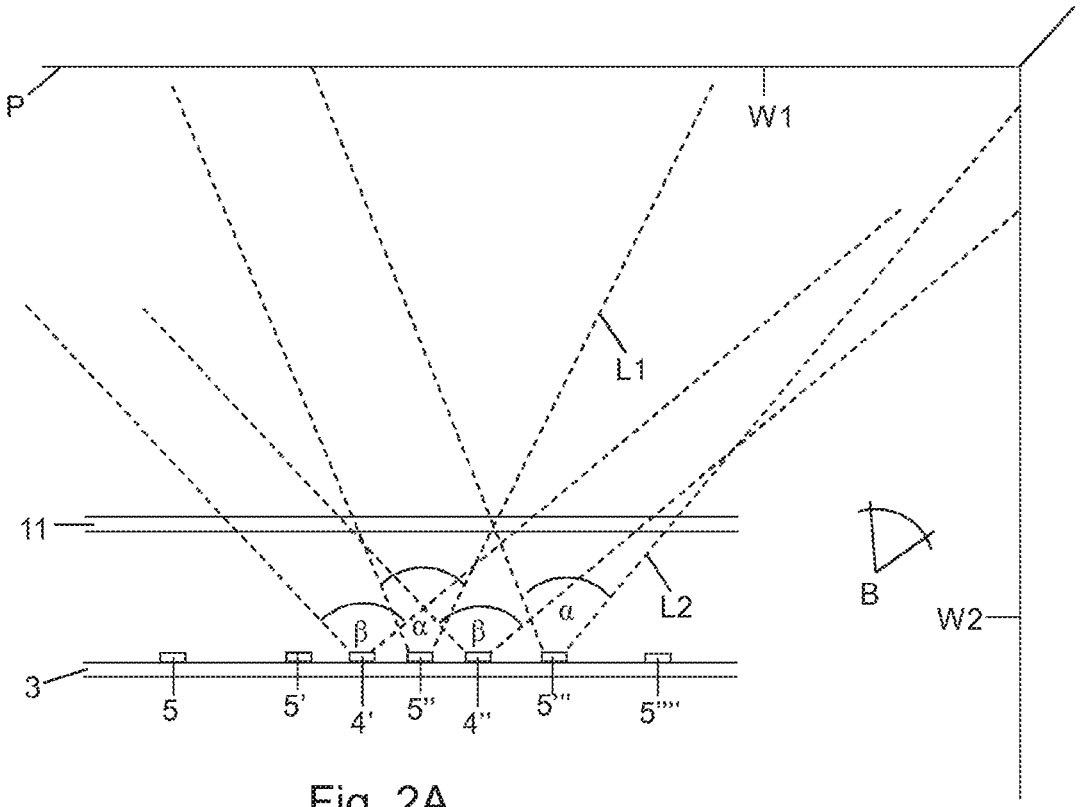
FIG. 2A shows a sketch of the light cones exiting from the first preferred embodiment of the device according to the invention onto a projection surface in a first snapshot.

FIG. 2A shows a sketch of the light cones L1; L2 exiting from the first preferred embodiment of the device according to the invention onto a projection surface P in a first snapshot during the simulation of a moving person on the basis of an LED sequence. Here, two white, constantly switched-on LED lamps 4', 4" illuminate an interior of a building with a beam angle $\beta$ of preferably 30° to 180°, more preferably 60° to 120°, and form basic lighting as a result. Two walls W1; W2, which are angled with respect to one another, in an interior of a building form the projection surface P. Two of the white LED lamps 5; 5'; 5"; 5'''; 5'''' functioning as effect lights are likewise switched on here and create light cones L1; L2 with a beam angle $\alpha$ of preferably 30° to 120°, more preferably 50° to 90°. For example, here the LED lamp 5" dims straight down, whilst the LED lamp 5''' dims straight up to create an LED sequence. An observer B outside the building for example sees the light cone L2 of the LED lamp 5''' and a light cone of the LED lamp 4" on a wall W2.

Figure 2B:
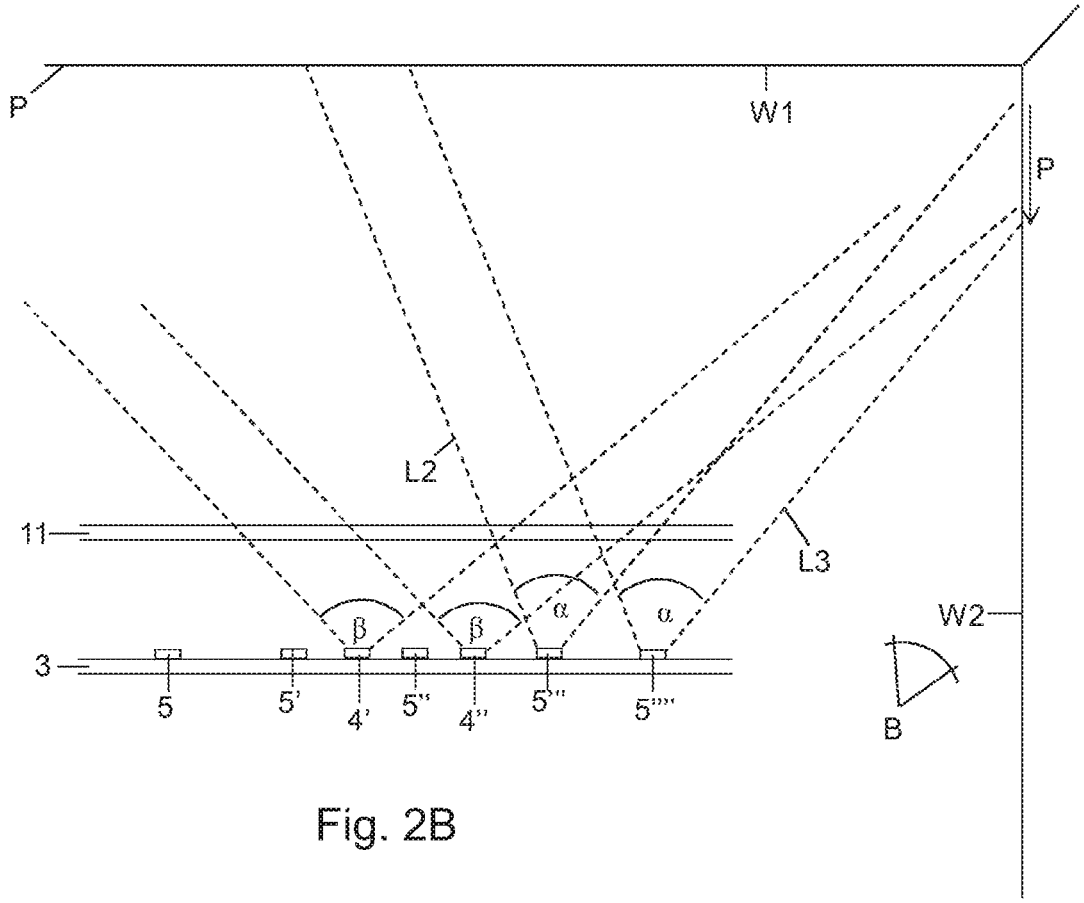
FIG. 2B shows a sketch of the light cones exiting from the first preferred embodiment of the device according to the invention onto a projection surface in a second snapshot.

FIG. 2B shows a sketch of the light cones L2; L3 exiting from the first preferred embodiment of the device 1 according to the invention onto a projection surface P in a later, second snapshot. Here, the LED lamp 5''' dims straight down, whilst the LED lamp 5'''' dims straight up and creates a new light cone L3. In this case, the light cones L2 and L3 travel on the wall W2 in arrow direction P and the impression of a moving person is created here for the external observer B.

Figure 3A:
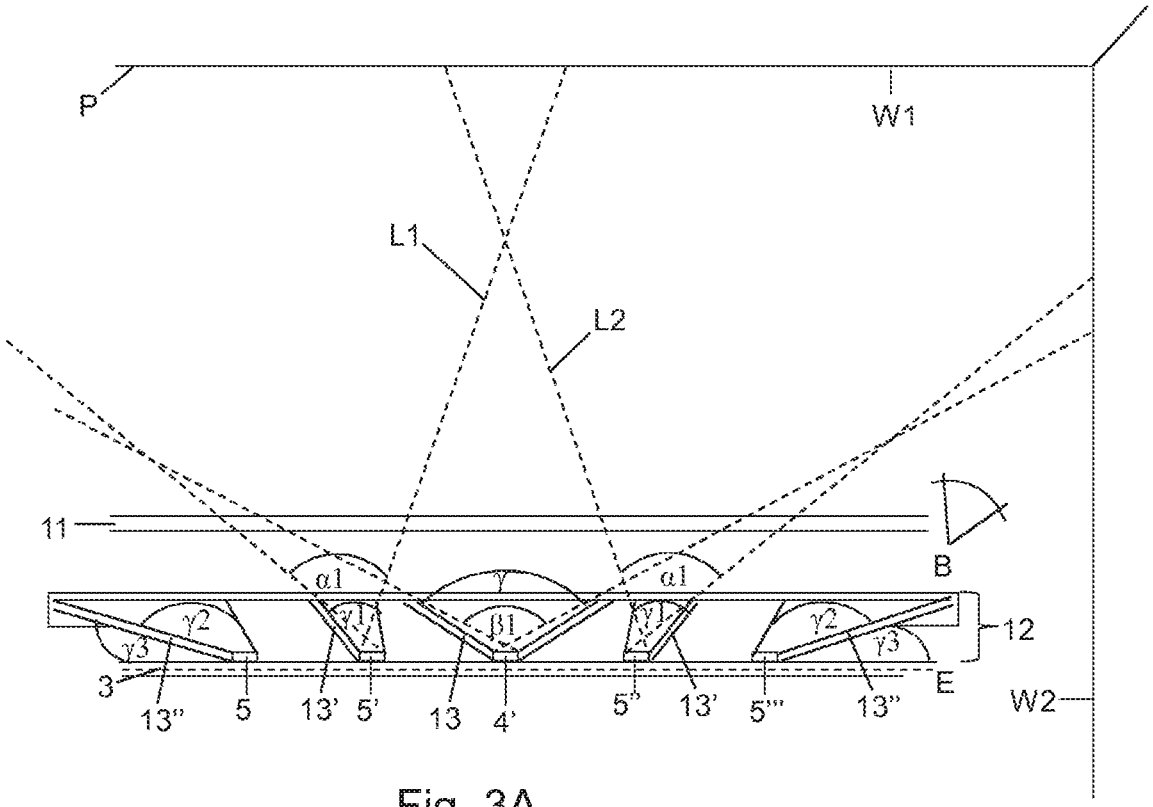
FIG. 3A shows a sketch of the light cones exiting from a second preferred embodiment of the device according to the invention onto a projection surface in a first snapshot, wherein here, the device comprises an additional light shaper for delimiting the light cones.

FIG. 3A shows a sketch of the light cones L1; L2 exiting from a second preferred embodiment of the device 1 according to the invention onto a projection surface P in a first snapshot, wherein the device 1 here comprises an additional light-shaping element 12 for delimiting the light cones, which can theoretically be achieved (cf. FIGS. 2A and 2B) of the LED lamps 4', 5; 5'; 5''; 5'''. The at least partially non-light-permeable light-shaping element 12 is here placed between the LED lamps 4', 5; 5'; 5''; 5''' and the projection surface P. Here, by way of example, one white LED lamp 4' for creating basic lighting and also four white LED lamps 5; 5'; 5''; 5''' arranged in a row for creating an LED sequence are arranged on the LED circuit board 3.

A section through the light-shaping element 12, essentially centrally through or along the LED lamps 4', 5; 5'; 5''; 5''', which are arranged in a row here, can be seen in FIG. 3A. As indicated here for example, this light-shaping element 12 can be constructed as a deep-drawn plastic part. These deep-drawn sections or depressions 13; 13'; 13'' of the light-shaping element 12 can here be understood as funnels, wherein these funnels can for example have the shape of a straight or oblique cone, a tetrahedron or a square or rectangular pyramid. As can be seen in FIG. 3A, the depressions 13; 13'; 13'' are simultaneously used as sockets for the LED lamps 4'; 5; 5'; 5''; 5'''.

A preferred light-shaping element 12, at least in the longest extent shown in FIG. 3A, shows a symmetrical structure with an axis of symmetry running through the LED lamp 4'. Furthermore, the depression 13, at least in the longest extent, has an angle γ1 between two opposite side surfaces of preferably between 60° and 140°, very particularly preferably approximately 120°. Furthermore, the depressions 13, at least in the longest extent of the light-shaping element 12, have an angle γ between two opposite side surfaces of preferably between 10° and 80°, very particularly preferably approximately 30°. In addition, the depressions 13'', at least in the longest extent of the light-shaping element 12, have an angle γ2 between two opposite side surfaces of very particularly preferably approximately 44°.

Figure 3B:
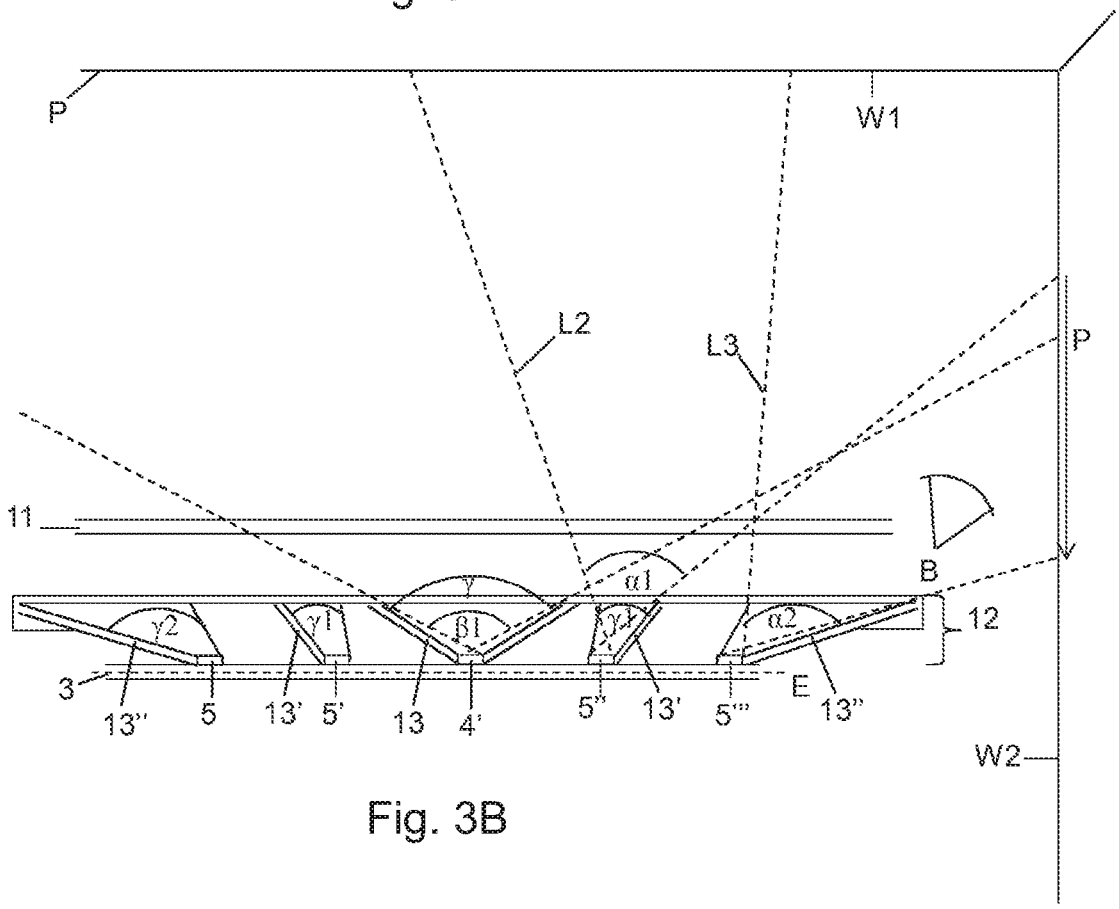
FIG. 3B shows a sketch of the light cones exiting from the second preferred embodiment of the device according to the invention onto a projection surface in a second snapshot.

Preferably, the LED lamps 4, 5; 5'; 5''; 5''' and the funnel-shaped depressions 13; 13'; 13'' of the light-shaping element 12 are dimensioned in such a manner that the delimited beam angle α1, measured crosswise across the LED lamps 5'; 5'' mounted in the depressions 13', of preferably 30° to 120°, very particularly preferably approximately 70°, can be achieved, and that the delimited beam angle α2, measured crosswise across the LED lamps 5; 5''' mounted in the depressions 13'', of preferably 30° to 120°, very particularly preferably approximately 70° can be achieved (cf. FIG. 3B).

The two white LED lamps 5'; 5'' functioning as effect lights are switched on here and create light cones L1; L2. At the same time, a white, constantly switched-on LED lamp 4' illuminates an interior of a building with a delimited beam angle β1 of preferably 90° to 180°, very particularly preferably approximately 125°, and forms basic lighting as a result.

For example, here the LED lamp 5' dims straight down, whilst the LED lamp 5'' dims straight up to create an LED sequence. An observer B outside the building for example sees the light cone L2 of the LED lamp 5'' and a light cone of the LED lamp 4' on a wall W2.

FIG. 3B shows a sketch of the light cones L2; L3 exiting from the second preferred embodiment of the device 1 according to the invention onto a projection surface P in a later, second snapshot. Here, the LED lamp 5'' dims straight down, whilst the LED lamp 5''' dims straight up and creates a new light cone L3. In this case, the light cones L2 and L3 travel on the wall W2 in arrow direction P and the impression of a moving person is created here for the external observer B. On the basis of FIG. 3B, it is indicated that—compared with FIG. 2B—the overlap of the light cones L2; L3 is smaller. Also, the arrow P is longer with the light-shaping element 12 according to FIG. 3B than without light-shaping element 12 according to FIG. 2B, which points to a stronger delimitation of the light cones L2; L3. Furthermore, it can be seen particularly well from FIG. 3B that the depressions 13'' belonging to the external LED lamps 5; 5''' are open or tilted to the external ends, in order to achieve an illumination which is as wide as possible, virtually corresponding to the technically possible beam angle of the LED lamps 5; 5''', i.e. towards the wall W2, wherein an angle γ3 between the side surface orientated towards the wall W2 and a plane E defined by the LED circuit board 3 preferably corresponds to less than 20°, whilst the opposite side surface is, at most, at right angles to the plane E.

Figure 4:
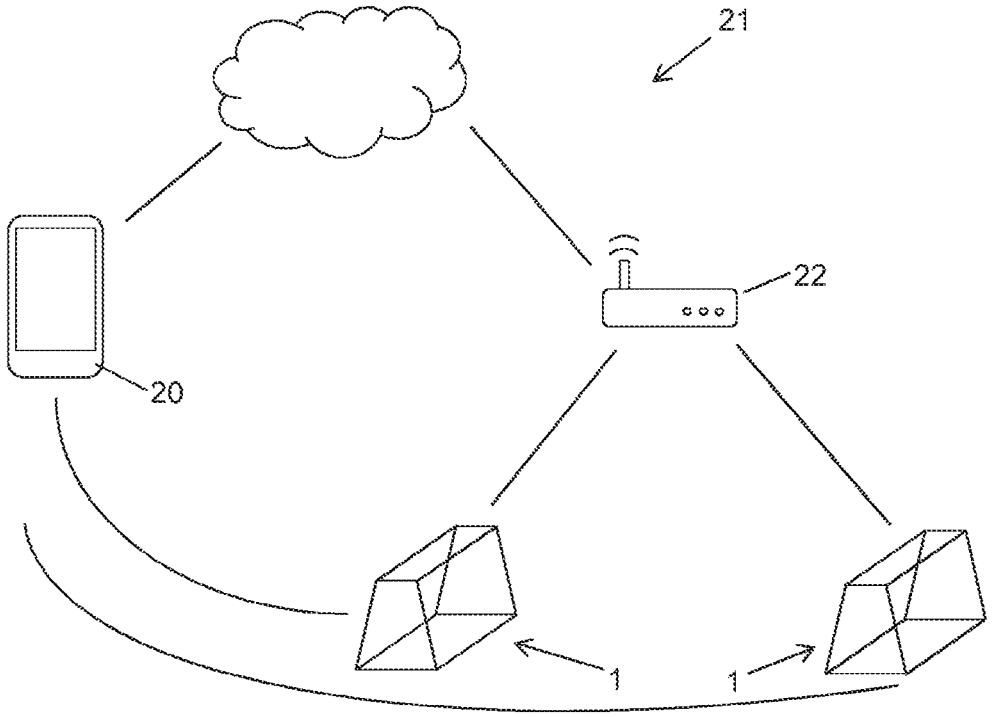
FIG. 4 shows a schematic illustration of a plurality of the preferred embodiments of the device according to the invention connected to a wireless network environment.

FIG. 4 shows a schematic illustration of a plurality of the preferred embodiments of the device according to the invention connected to a wireless network environment 21.

On the basis of an external control device, here a smartphone 20 by way of example, it may be possible to activate and configure the device 1 for example via the internet and an internet router 22. Preferably, a suitable app is installed on the smartphone 20 for this.

Alternatively or additionally, the device 1 may comprise a Bluetooth module, as a result of which it may also be possible to activate and configure the external control device directly using the device.

Preferably, in addition, one device 1 additionally comprises a user interface, which can be operated manually, in each case.

REFERENCE LIST

1 Device
2 Control
3 LED circuit board
4; 4' LED lamps, white (basic lighting)
5; 5'; 5''; 5'''; 5''' LED lamps, white (effect lights)
6; 6' LED lamps, blue (TV simulation)
7 Housing
11 Transparent light-permeable cover
12 Light-shaping element
13; 13'; 13'' Depressions (of the light-shaping element)
14 Computer
15 Loudspeaker
16 Brightness sensor
20 Smartphone
21 Network environment
22 Internet router
α Beam angle (LED-lamp sequence)
α1; α2 Delimited beam angle (LED lamp sequence with light-shaping element)
β Beam angle (basic lighting)
β1 Delimited beam angle (basic lighting with light-shaping element)

B Observer
E Plane (defined by LED circuit board)
L1 First light cone
L2 Second light cone
L3 Third light cone
P Projection surface
W1; W2 Walls (interior)

The invention claimed is:

1. A method for simulating shadows of one or more persons moving in a building, the method comprising:

creating basic lighting on the basis of at least one lamp, particularly LED lamp;

switching on a sequence circuit made up of at least two lamps, particularly a sequence circuit made up of at least two LED lamps, wherein the at least two lamps are activated in such an alternate manner that movements or shadows of one or more persons are simulated, and wherein the sequence circuit is configured as an LED sequence made up of at least two lamps, wherein in each case, a subsequent lamp, is dimmed up during the dimming down of the preceding lamp in the series, and wherein a time period between the dimming down of the preceding lamp in the series and dimming up the following lamp corresponds to at least 20 milliseconds, more preferably is between 20 milliseconds and 5 seconds, very particularly preferably between 40 milliseconds and 2 seconds.

2. A device for simulating shadows and/or simulating noises of one or more persons, the device comprising:

a control;

at least one lamp, particularly a white LED lamp for creating basic lighting;

at least two further lamps, particularly white LED-lamps, wherein the at least two further lamps can be activated alternately in such a manner on the basis of the control and switched on or switched off in sequence, so that movements or shadows of one or more persons are simulated, and an at least partially non-light-permeable light-shaping element placed between the lamps and a projection surface, wherein the light-shaping element is constructed as deep-drawn plastic part comprising funnel-type depressions in the shape of a straight or oblique cone, a tetrahedron, or a square or rectangular pyramid, wherein the at least one lamp and the at least two further lamps are arranged in the depressions.

3. The device according to claim 2, wherein the sequence circuit is configured in such a manner that the at least two further lamps can be switched on or switched off in sequence for creating a lamp sequence.

4. The device according to claim 3, wherein the control is configured in such a manner that in each case, a subsequent lamp, is dimmed up during the dimming down of the preceding lamp in the series.

5. The device according to claim 2, wherein the device comprises a transparent, light-permeable cover which allows the passage of light cones of the LED lamps created.

6. The device according to claim 2, wherein the device comprises a brightness sensor for detecting light sources located outside the device for automatically adapting a light intensity of the LED lamps.

7. The device according to claim 2, wherein the device comprises at least one loudspeaker connected to a computer for simulating noises of one or more persons.

8. The device according to according to claim 2, wherein the device comprises a microphone for detecting noises of third parties.

9. The device according to claim 5, wherein an angle y of between 0° and 90°, more preferably between 10° and 80°, is spanned between a plane, in which an LED circuit board lies, and a datum plane of the device.

10. The device according to according to claim 2, wherein the device is connected to an, in particular wireless, network environment, so that the device can be activated and configured by means of a control device, particularly a smartphone.

11. A security system including the device according to claim 2.

12. The device according to claim 2, further comprising at least one colored LED lamp configured for simulating light of a switched-on TV.

13. A method for simulating shadows of one or more persons moving in a building, the method comprising:

creating basic lighting on the basis of at least one lamp;

switching on a sequence circuit including at least two LED lamps;

wherein the at least two LED lamps are arranged as a preceding LED lamp followed by a subsequent LED lamp and configured for activation in an alternate manner such that movements or shadows of one or more persons are simulated;

wherein the subsequent LED lamp is dimmed up during dimming down of the preceding LED lamp in the sequence circuit; and wherein a time period between the dimming down of the preceding LED lamp and dimming up of the subsequent LED lamp is at least 20 milliseconds.

14. The method according to claim 13, wherein the time period between the dimming down of the preceding LED lamp and dimming up of the subsequent LED lamp is between 20 milliseconds and 5 seconds.

15. The method according to claim 13, wherein the time period between the dimming down of the preceding LED lamp and dimming up of the subsequent LED lamp is between 40 milliseconds and 2 seconds.

16. The method according to claim 13, wherein the at least one lamp is an LED lamp.

* * * * *